US006823994B2

(12) United States Patent
Tsaur

(10) Patent No.: US 6,823,994 B2
(45) Date of Patent: Nov. 30, 2004

(54) FLOW CONTROL/SHOCK ABSORBING SEAL

(76) Inventor: Garry Tsaur, 19222 Tranbarger St., Rowland Heights, CA (US) 91748

( * ) Notice: Subject to any disclaimer, the term of this patent is extended or adjusted under 35 U.S.C. 154(b) by 21 days.

(21) Appl. No.: 10/068,678

(22) Filed: Oct. 26, 2001

(65) Prior Publication Data

US 2003/0080019 A1 May 1, 2003

(51) Int. Cl.[7] ..... B65D 81/02
(52) U.S. Cl. ..... 206/521; 222/187
(58) Field of Search ..... 222/157, 92, 107, 222/541.6; 206/521, 591, 593, 594, 524.1, 524.4, 205, 524.8, 210, 204; 424/43, 49

(56) References Cited

U.S. PATENT DOCUMENTS 5,702,035 A * 12/1997 Tsao ..... 222/187

* cited by examiner

*Primary Examiner*—Shian T. Luong
(74) *Attorney, Agent, or Firm*—Joe Nieh

(57) ABSTRACT

The present invention is a flow control/shock absorbing seal that will absorb the shocks transmitted to the liquids in a container during transportation to prevent leakage and maintain the separation of the liquid and the air chamber in the container and controls the rate of flow of the liquid from the container. The present invention allows the rate of flow of the liquid from the container to be predetermined and controlled economically and accurately. The present invention may also allow the forced ejection of the liquid from the container.

5 Claims, 1 Drawing Sheet

FLOW CONTROL/SHOCK ABSORBING SEAL

BACKGROUND-FIELD OF INVENTION

The present invention relates to a flow control/shock absorbing seal for controlling the flow of liquids and absorbing the shocks during transportation of the liquid.

BACKGROUND-DESCRIPTION OF RELATED ART

Containers that enclose liquids to be stored and transported must be leak-proof and yet must open easily for access to its contents. During transportation of the containers, the liquid in the containers may experience shock and the resulting pressure may rupture the containers and/or cause the liquid to leak from the containers. Furthermore, when the containers are opened for access to their contents, there is no control over the rate of the flow of the liquid from the containers. There is no economical and accurate method of presetting the rate of flow of the liquids from the containers.

SUMMARY OF THE INVENTION

The present invention is a flow control/shock absorbing seal that will absorb the shocks transmitted to the liquids in a container during transportation to prevent leakage and maintain the separation of the liquid and the air chamber in the container and controls the rate of flow of the liquid from the container after opening. The present invention allows the rate of flow of the liquid from the container to be predetermined and controlled economically and accurately. The present invention may also allow the forced ejection of the liquid from the container.

DETAILED DESCRIPTION OF THE PREFERRED EMBODIMENT

Figure 1:
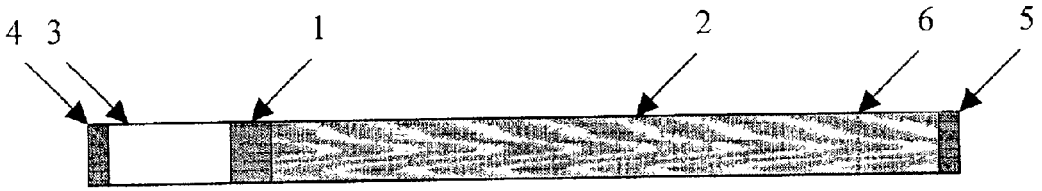
FIG. 1 shows the flow control/shock absorbing seal 1 inserted in one end 4 of the container that can only be opened from the end 5 of the container containing the liquid 2.

FIG. 1 shows the preferred embodiment of the flow control/shock absorbing seal 1. A flow control/shock absorbing seal 1 is inserted in one end 4 of a long slender cylindrical container that can be opened from the end 5 with the liquid 2. The container is partially filled with the desired liquid 2 such as medications, mouthwash, mint, or any other chemicals. The flow control/shock absorbing seal 1 is inserted at one end 4 of the container enclosing the liquid 2. A predetermined air chamber 3 is maintained on the end 4 of the container with the flow control/shock absorbing seal 1 separated from the liquid 2 by the flow control/shock absorbing seal 1. The container is sealed on both ends 4, 5 so that no leakage of the liquid 2 is possible. The container can be broken open at predetermined location 6 in the liquid 2 portion of the container at the scoring placed outside perimeter of the container at the predetermined location 6.

During transportation, the flow control/shock absorbing seal 1 will resist movement of the liquid 2 and dampen any shock it may experience by transferring the pressure to the air in the air chamber 3 and dissipate the pressure and maintain containment of the liquid 2. When the liquid 2 is to be release from the container, it is broken open at the predetermined locations 6 determined by the scorings on the container. Once the container is opened, the liquid 2 may be sucked out of the container by the vacuum created by the end user's mouth placed at the open end 5 of the container.

The container may also be sealed in an environment with above normal air pressure which will create a pressurized air chamber 3. The liquid 2 is incompressible. The air in the air chamber 3 will be pressurized to the same pressure as the pressurized environment it was sealed in. The flow control/shock absorbing seal 1 will maintain the separation of the air chamber 3 and the liquid 2. The flow control/shock absorbing seal 1 will also dampen the shocks experienced during transportation by transferring the pressure to the air in the air chambers 3. The container is sealed on both ends 4, 5 so that no leakage of the liquid 2 is possible. The container can break open at predetermined location 6 in the liquid 2 portion of the container by scoring the outside perimeter of the container at the predetermined location 6.

During transportation, the flow control/shock absorbing seal 1 will resist movement of the liquid 2 and dampen any shock it may experience by transferring the pressure to the air in the air chamber 3 and dissipate the pressure and maintain containment of the liquid 2. When the liquid 2 is to be release from the container, it is broken open at the predetermined location 6 determined by the scorings on the container. Once the container is opened, the liquid 2 will be forced out of the container by the air pressure in the air chamber 3 at a rate determined by the air pressure and the viscosity and the length of the flow control/shock absorbing seal 1. A higher viscosity and/or longer flow control/shock absorbing seal 1 will allow the liquid 2 to flow out of the container after a predetermined delay and at a slow controlled speed. A lower viscosity and/or shorter flow control/shock absorbing seal 1 will allow the liquid 2 to flow out of the container almost immediately and at a rapid speed. The amount of liquid 2 to be release can be determined by breaking the end 5 of the container containing the liquid 2 at predetermined location 6. The end 5 containing the liquid 2 that breaks off from the container will retain the liquid 2 within it since it is sealed on one end 5 and atmospheric air pressure will prevent the liquid 2 contained within it from being released.

Figure 2:
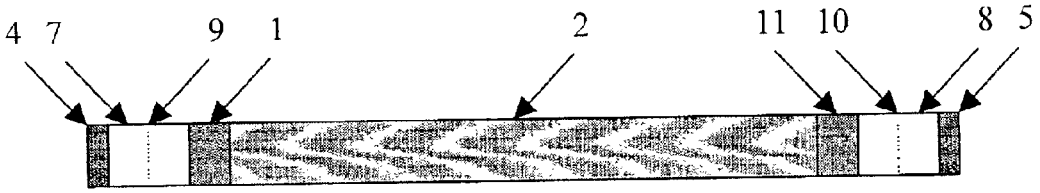
FIG. 2 shows the flow control/shock absorbing seals 1, 11 inserted in both ends 4, 5 of the container that can be opened at either end 4, 5 of the container.

FIG. 2 shows another embodiment of the flow control/shock absorbing seal 1, 11. A flow control/shock absorbing seal 1, 11 is inserted in each end 4, 5 of a container that can be opened from both ends 4, 5. The container is partially filled with the desired liquid 2 such as medications, mouthwash, mint, or any other chemicals. The two flow control/shock absorbing seals 1, 11 are inserted at both ends 4, 5 of the container enclosing the liquid 2. A predetermined air chamber 7, 8 is maintained on both ends 4, 5 of the container separated from the liquid 2 by the flow control/shock absorbing seals 1, 11. The container is sealed on both ends 4, 5 so that no leakage of the liquid 2 is possible. The container can break open at predetermined locations 9, 10 in the air chambers 7, 8 at the scoring placed at the outside perimeter of the container at the predetermined locations 9, 10.

During transportation, the flow control/shock absorbing seals 1, 11 will resist movement of the liquid 2 and dampen any shock it may experience by transferring the pressure to the air in the air chambers 7, 8 and dissipate the pressure and maintain containment of the liquid 2. When the liquid 2 is to be release from the container, it is broken open at the predetermined locations 9, 10 determined by the scorings on the container. Once both end of the container are opened, the liquid 2 will flow out of the container at a rate determined by the viscosity and the length of the flow control/shock absorbing seals 1, 11. A higher viscosity and/or longer flow control/shock absorbing seal 1, 11 will allow the liquid 2 to flow out of the container after a predetermined delay and at a slow controlled speed. A lower viscosity and/or shorter flow control/shock absorbing seal 1, 11 will allow the liquid 2 to flow out of the container almost immediately and at a rapid speed. No liquid 2 is wasted or leaked since the openings are at the air chambers 7, 8 and the flow control/shock absorbing seals 1, 11 will contain the liquid 2 in the container until the container is opened at both ends 4, 5 and the weight of the liquid 2 forces its way through the flow control/shock absorbing seal 1 or 11.

The container may be sealed in an environment with above normal air pressure which will create pressurized air chambers 7, 8. The liquid 2 is incompressible. The air in the air chambers 7, 8 will be pressurized to the same pressure as the pressurized environment it was sealed in. Since there are air chambers 7, 8 in both ends 4, 5 of the container, the liquid 2 will maintain its position in the middle of the container. The flow control/shock absorbing seals 1, 11 will maintain the separation of the air chamber 7, 8 and the liquid 2. The flow control/shock absorbing seals 1, 11 will also dampen the shocks experienced during transportation by transferring the pressure to the air in the air chambers 7, 8.

When the liquid 2 is to be release from the container, either end 4 or 5 of the container may be broken open. Once the container is open, the air pressure in the air chamber 7 or 8 at the unopened end of the container will force the liquid 2 out of the container at a predetermined rate after a predetermined delay. The liquid 2 will flow out of the container at a rate determined by the viscosity and the length of the flow control/shock absorbing seals 1, 11. A higher viscosity and/or longer flow control/shock absorbing seal 1, 11 will allow the liquid 2 to flow out of the container after a predetermined delay and at a slow controlled speed. A lower viscosity and/or shorter flow control/shock absorbing seal 1, 11 will allow the liquid 2 to flow out of the container almost immediately and at a rapid speed. No liquid 2 is wasted or leaked since the opening is at the air chamber 7 or 8 and the flow control/shock absorbing seals 1, 11 will contain the liquid 2 in the container until the container is opened.

Figure 3:
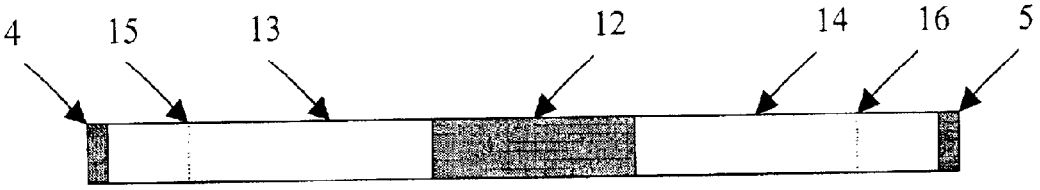
FIG. 3 shows the flow control/shock absorbing seal 12 inserted in the container separating the container into two air chambers 13, 14 that can be opened at either end 4, 5 of the container.

FIG. 3 shows another embodiment of the flow control/shock absorbing seal 12. A flow control/shock absorbing seal 12 is inserted in the container that can be opened from both ends 4, 5. A predetermined air chamber 13, 14 is maintained on both ends 4, 5 of the container separated by the flow control/shock absorbing seal 12. The container is sealed in a partial vacuum or negative pressure environment on both ends 4, 5. After the container is sealed on both ends 4, 5, the air chambers 13, 14 will have a partial vacuum or negative pressure. The container can be broken open at predetermined locations 15, 16 in the air chambers 13, 14 at the scoring placed at the outside perimeter of the container at the predetermined locations 15, 16.

The resulting container may be used to collect liquid samples easily. To use the container to collect liquid samples such as saliva or other body fluids for medical examinations, the container is broken open at one of the predetermined locations 15 determined by the scorings on the container and placed in contact with the liquid to be collected thereby sealing the opened end 4. Once the container is opened at one end 4, the vacuum in the air chamber 14 in the other end 5 of the container would slowly move the flow control/shock absorbing seal 12 toward the still closed end 5 after a predetermined delay which would allow sufficient time to place the container in contact with the liquid to be collected. The movement of the flow control/shock absorbing seal 12 would create a vacuum at the opened end 4 of the container and thereby suck the liquid into the container and retain it in the container. When the collected liquid is to be released from the container, the other still closed end 5 is broken open at the predetermined location 16, allowing air to enter the air chamber 14 thereby balancing the partial vacuum or negative pressure in the air chamber 14. When atmospheric air enters the air chamber 14, the collected liquid will then be slowly released after a predetermined delay. The collected liquid will flow into and out of the container at a rate determined by the viscosity and the length of the flow control/shock absorbing seal 12. A higher viscosity and/or longer flow control/shock absorbing seal 12 will allow the collected liquid to flow into and out of the container after a predetermined delay and at a slow controlled speed. A lower viscosity and/or shorter flow control/shock absorbing seal 12 will allow the collected liquid to flow into and out of the container almost immediately and at a rapid speed.

What is claimed is:

1. A flow control/shock absorbing seal comprising:

a housing with a scoring at a predetermined locations and with two ends that are sealed to prevent leakage of a liquid contained within it;

a seal comprising of a viscous substance inserted in the housing separating the liquid from the air thereby creating an air chamber;

wherein said seal will maintain the separation between the liquid and the air in the housing and transmit the shock experienced by the liquid during transportation to the air thereby dampening the pressure, and will control the flow of the liquid through the seal and out the container when the container is opened at the scoring at the predetermined locations.

2. A flow control/shock absorbing seal comprising:

a housing with a scoring at one or more predetermined locations and with two ends that are sealed to prevent leakage of a liquid contained within it;

two seals comprising of a viscous substance are inserted at either end of the housing separating the liquid contained in the housing from an air chambers at either end of the housing;

wherein the two seals will maintain the separation between the liquid and the air in the housing and transmit the shock experienced by the liquid during transportation to the air thereby dampening the pressure, and will control the flow of the liquid through the seals and out the container when the container is opened at the scoring at one or more predetermined locations.

3. A flow control/shock absorbing seal comprising:

a housing with a scoring at a predetermined location and with two ends that are sealed to prevent leakage of a liquid contained within it;

a seal comprising of a viscous substance inserted in the housing separating the liquid from the air thereby creating an air chamber;

wherein the housing is sealed in a pressurized environment such that the air chamber sealed within it are pressurized and wherein said seal will maintain the separation between the liquid and the air in the housing and transmit the shock experienced by the liquid during transportation to the air thereby dampening the pressure, and will control the flow of the liquid through the seal and out the container when the container is opened at the scoring at the predetermined location.

4. A flow control/shock absorbing seal as in claim 2, wherein the housing is sealed in a pressurized environment such that the air chambers sealed within it are pressurized.

5. A flow control/shock absorbing seal comprising:

a housing with negatively pressurized interior space with a scoring at two or more predetermined locations and with two ends that are sealed to maintain the negative pressure;

a seal comprising of a viscous substance inserted in the housing separating the housing into two air chambers;

wherein said seal will maintain the separation between the air chambers, and when one end of the housing is opened at the scoring at the predetermined location, the vacuum at the other end of the housing will suck any fluid place in contact with the open end of the housing into the housing after a predetermined delay, and when the other end of the housing is also opened, the collected liquid will be released at a controlled rate after a predetermined delay.

* * * * *